United States Patent [19]

Kobler

[11] Patent Number: 4,643,506

[45] Date of Patent: Feb. 17, 1987

[54] WIRE SEAL

[75] Inventor: Robert J. Kobler, Harrisburg, Pa.

[73] Assignee: AMP Incorporated, Harrisburg, Pa.

[21] Appl. No.: 735,890

[22] Filed: May 17, 1985

[51] Int. Cl.[4] ..... H01R 4/00

[52] U.S. Cl. ..... 339/94 M; 339/91 R

[58] Field of Search ..... 339/94, 60, 103 R, 103 M, 339/59 R, 59 M, 61 R, 61 M, 91 R, 213 R

[56] References Cited

U.S. PATENT DOCUMENTS

| | | | |
|---|---|---|---|
| 3,792,416 | 2/1974 | Moulin | 339/94 R |
| 4,072,383 | 2/1978 | Cameron | 339/136 R |
| 4,150,866 | 4/1979 | Snyder et al. | 339/94 M |
| 4,460,227 | 7/1984 | Ball | 339/103 B |

FOREIGN PATENT DOCUMENTS

| | | | |
|---|---|---|---|
| 2844787 | 5/1979 | Fed. Rep. of Germany | 339/60 M |
| 3201324 | 7/1983 | Fed. Rep. of Germany . | |
| 2130026 | 5/1984 | United Kingdom | 339/60 R |

*Primary Examiner*—Gil Weidenfeld
*Assistant Examiner*—David L. Pirlot
*Attorney, Agent, or Firm*—Anton P. Ness

[57] ABSTRACT

An elastomeric wire seal for an individual electrical conductor has a forward conductor-engaging section, an intermediate housing-engaging section, and a rearward section which extends rearwardly from the connector housing when the wire seal is secured in a rearward portion of a terminal-receiving cavity of the housing. The rearward section has an annular ridge extending radially inwardly into the profiled bore of the wire seal so that when a terminated conductor has been inserted therethrough the annular ridge sealingly engages the conductor. The conductor is thus sealingly engaged at locations forwardly and rearwardly from the location where the wire seal sealingly engages the sidewalls of the rearward cavity portion.

13 Claims, 5 Drawing Figures

WIRE SEAL

FIELD OF THE INVENTION

The invention relates to the field of electrical connectors and more particularly to wire seals for electrical connectors.

BACKGROUND OF THE INVENTION

Electrical connectors are known which receive in terminal receiving cavities thereof one or more electrical conductors having terminals terminated on ends thereof, which terminals electrically engage mating terminals in a corresponding electrical connector. Wire seals are known which are disposed around each electrical conductor at the rearward end of the connector to provide a sealing engagement between the conductor and the connector housing. Each wire seal is disposed in an enlarged housing, has a rearward portion in interference fit with the sidewalls of the rearward cavity section, and also has a forward portion which engages the conductor in interference fit therearound, such as is disclosed in U.S. Pat. No. 4,150,866.

It is desirable to provide a wire seal which sealingly engages a conductor at two spaced locations for improved sealing, and it is desirable to provide redundant sealing thereby to minimize the possibility of improper sealing due to possible tearing of the wire seal at one of the two locations during insertion or removal of a terminated conductor.

It is also desirable to provide two locations for sealing engagement with a conductor where each location is axially spaced from that location where the wire seal engages the sidewalls of the rearward cavity section for sealing with the connector housing.

It is still further desirable to provide a wire seal which engages the conductor rearward from the housing to provide relief from lateral stress on the conductor adjacent the housing.

SUMMARY OF THE INVENTION

The wire seal of the present invention is made of a relatively incompressible elastomeric composition and has a forward section of reduced inner diameter for sealingly engaging a conductor extending therethrough, an intermediate cylindrical section of enlarged inner and outer diameters for sealingly engaging the sidewalls of a rearward section of the terminal-receiving cavity of the connector housing, and a rearward section for sealingly engaging the conductor at a location spaced rearwardly from the connector housing. The rearward seal section has an annular portion of reduced inside diameter selected to be slightly smaller than the outer diameter of the insulated conductor to be inserted therethrough. The rearward seal section also has portions adjacent thereto having tapered inside surfaces extending forwardly and rearwardly from the reduced-diameter portion, which tapered surfaces facilitate insertion and removal of the terminated conductor therethrough. The tapers are preferably gradual providing strength for tear resistance, resistance against buckling during insertion of the terminated conductor, and lateral strain relief. Each wire seal of the present invention can accommodate conductors of several adjacent wire sizes.

DETAILED DESCRIPTION OF THE PREFERRED EMBODIMENT

Figure 1:
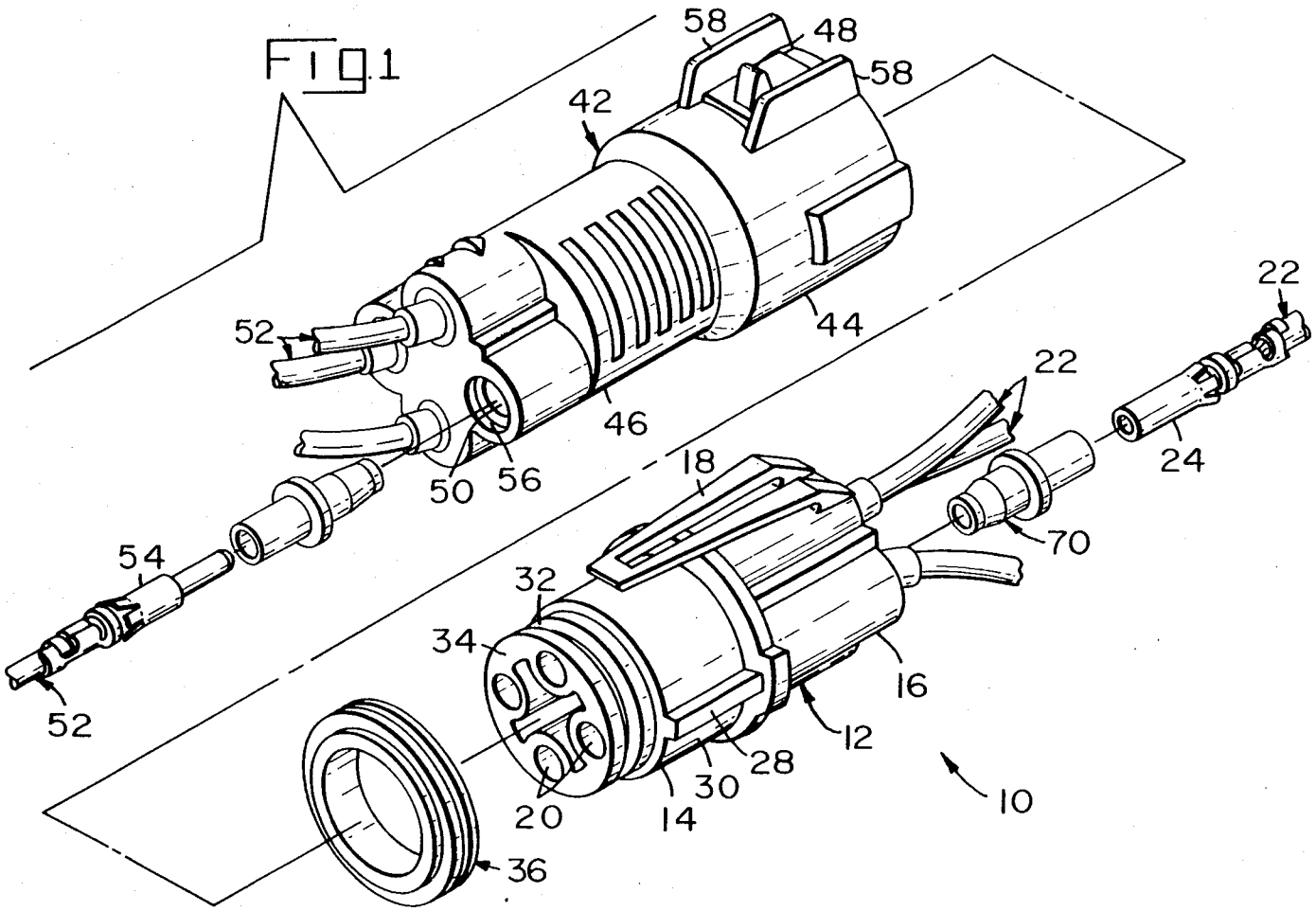
FIG. 1 is a perspective view of a connector assembly with the wire seals and terminated conductors exploded from the mating connector housings.

FIG. 1 illustrates a connector assembly 10 with which the wire seal 70 of the present invention is used. A first connector housing 12 has a forward or plug section 14, a rear section 16, latch arms 18, and a plurality of terminal-receiving cavities 20 extending axially therethrough. Conductors 22 have socket terminals 24 terminated on forward ends thereof; wire seals 70 are disposed in enlarged rear portions 26 (shown in FIG. 3) of cavities 20 and sealingly engage around insulated portions of respective conductors 22. Keying ridges 28 extend axially along the peripheral surface 30 of plug section 14. Plug section 14 of housing 12 has an annular groove 32 therearound in peripheral surface 30 thereof, spaced from front surface 34. An annular sealing member 36 is disposed in annular groove 32.

A second connector housing 42 has a forward sleeve-like hood section 44, a rear section 46, latch projections 48, and a plurality of terminal-receiving cavities 50 extending axially therethrough. Conductors 52 have pin terminals 54 terminated on forward ends thereof; wire seals 70 are disposed in enlarged rear portions 56 of cavities 50 and sealingly engage around insulated portions of respective conductors 52. Keying channels (not shown) extend axially along the inner surface of hood section 44 corresponding to keying ridges 28 of mating housing 12. A pair of protective ribs 58 extend axially proximate to but circumferentially spaced from each latch projection 48.

Figure 2:
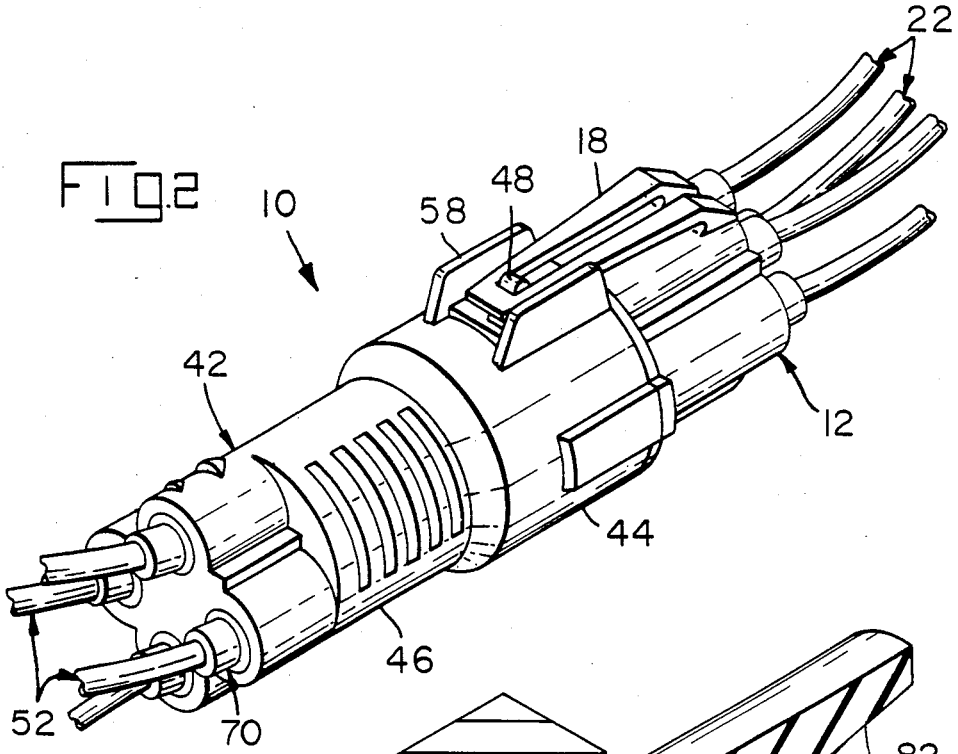
FIG. 2 is a perspective view of the connector assembly of FIG. 1 in assembled condition.

FIG. 2 shows the assembled sealed connector assembly 10 with housing 12 latchingly engaging housing 42, and hood section 44 containing plug section 14 therewithin and the pin and socket terminals electrically engaged therewithin. Terminated conductors 22 and 52 had been secured in respective terminal-receiving cavities 20, 50 of housings 12, 42 prior to mating housings 12 and 42 together. Keying ridges 28 and respective keying channels polarized the housings with respect to each other for appropriate mating. Latch arms 18 are latched behind latch projections 48. Protective ribs 58 protect the latch arms 18 from being inadvertently caught by stray wires. Annular sealing member 36 is deformed to sealingly engage the inner surface of hood section 44 and the bottom surface of groove 32 of plug section 14 thus providing sealing between housings 12 and 42.

Figure 3:
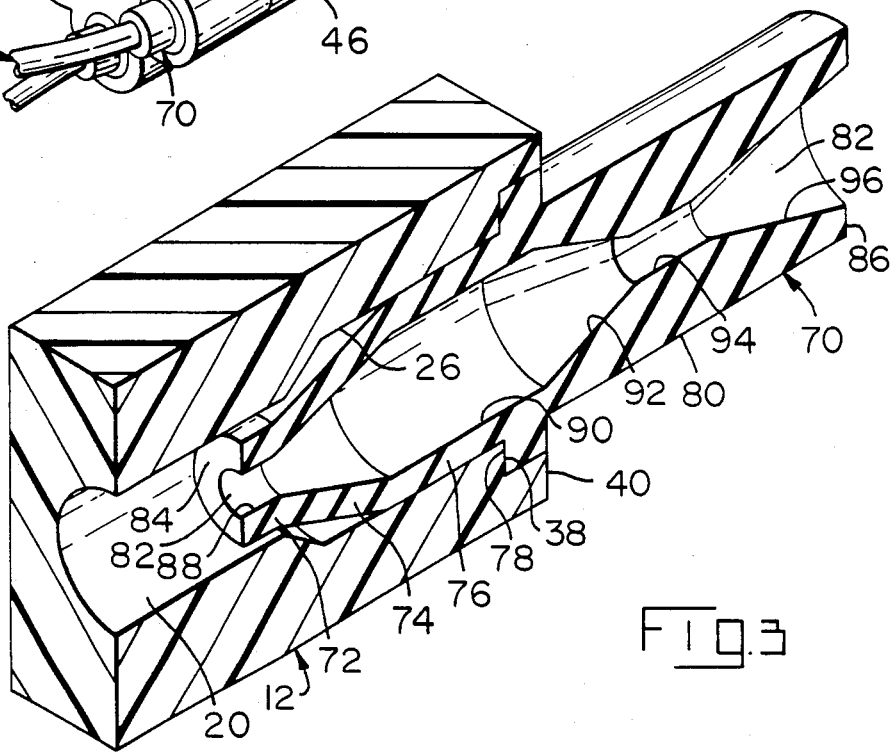
FIG. 3 is a part longitudinal section view of the rearward section of a housing with a wire seal of the invention disposed in a terminal-receiving cavity.

A preferred embodiment of wire seal 70 is shown in FIG. 3 in longitudinal section, shown disposed in an enlarged rear portion 26 of a terminal-receiving cavity 20 of housing 12, ready to receive a terminated conductor 22 insertably therethrough. Identical wire seals 70 would be similarly disposed in rear cavity portions 56 of housing 42. Annular seal stop section 78 is engaged by cooperating stop surface 38 recessed from rear surface 40 of housing 12 to prevent further axially forward movement of wire seal 70 along rear cavity portion 26. Wire seal 70 has a forward conductor-engaging section 72; a frustoconical section 74 rearwardly thereof; an intermediate section 76 having annular stop section 78 therearound; and a rear section 80. Forward section 72 has a thickness enabling radially outward elastic deformation by conductor 22 inserted therethrough. Intermediate seal section 76 has an outer diameter slightly larger than the inside diameter of rear cavity portion 26 to create an interference fit therewith to provide sealing engagement between wire seal 70 and housing 12. Rear seal section 80 extends rearwardly from connector housing 12 when wire seal 70 has been secured in rear cavity portion 26.

A profiled conductor-receiving bore 82 extends axially through wire seal 70 from forward end 84 to rearward end 86, as shown in FIG. 3. Forward bore section 88 within forward conductor-engaging section 72 has a reduced inner diameter selected to generate an interference fit of the conductor therein for sealing engagement. Proceeding rearwardly along profiled bore 82, the inner diamter is increased in frustoconical seal section 74 to a large inner diameter bore portion 90 in intermediate seal section 76. In rear seal section 80 an inward taper is provided at forward tapered portion 92 until a reduced inner diamter is achieved at rearward annular conductor-engaging seal portion 94 located near the forward end of rear seal section 80 preferably axially proximate to annular stop section 78. The inner diameter of wire seal 70 at annular portion 94 is selected to be less than the outer diameter of conductor 22 to generate an interference fit therebetween. It is preferred that reduced diameter annular portion 94 be axially proximate to annular stop section 78 so that when a terminal 24 is passing therethrough during insertion of terminated conductor 22, radially outward elastic deformation or bulging occurs at annular portion 94 which is adjacent annular stop section 78 and assists in resisting forward axial movement of wire seal 70 along rear cavity portion 26. Portions of a terminal are usually wider in diameter than the conductor to which it is terminated.

An outward taper is provided at rearward tapered portion 96 between reduced diameter annular portion 94 and rearward end 86, as seen in FIG. 3. Rearward tapered portion 96 provides a lead-in for insertion of a terminated conductor 22 forwardly thereinto, to strengthen rear seal section 80, and to reduce the possibility of tearing caused by such insertion at rearward conductor-engaging seal portion 94. Tapered portion 92 forward thereof provides strengthening to rear seal section 80, provides a "lead-out" facilitating removal of a terminated conductor 22 rearwardly from wire seal 70 during removal from connector housing 12, and reduces the possibility of tearing caused by such removal.

Figure 4A:
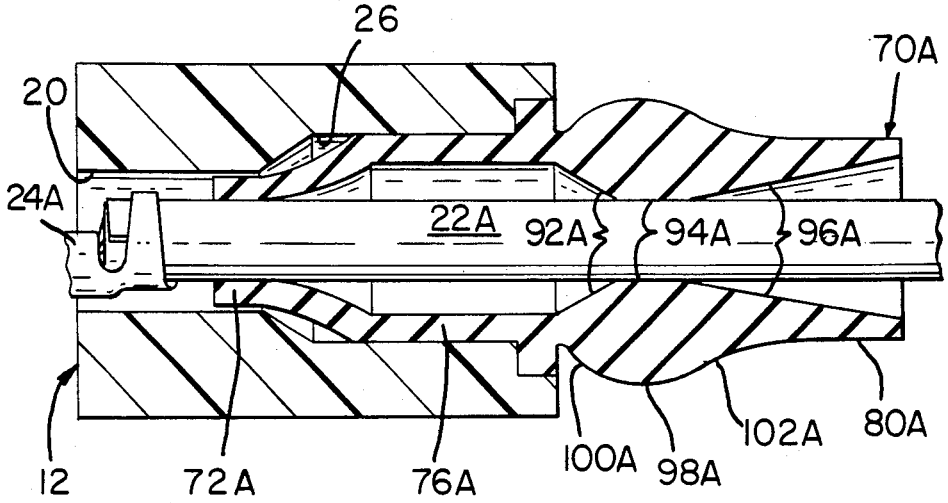
FIGS. 4A and 4B are similar to FIG. 3 wherein the wire seal has a conductor therein having relatively a large diameter and a small diameter respectively.
Figure 4B:
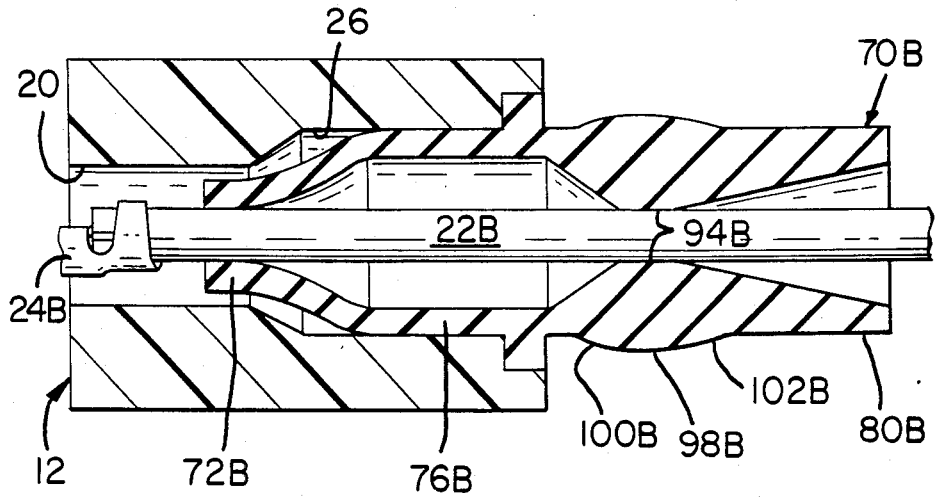

FIGS. 4A and 4B illustrate terminated conductors 22A and 22B having relatively larger and smaller diameter respectively, having been inserted through wire seals 70A, 70B. In FIG. 4A, large diameter conductor 22A having terminal 24A thereon has expanded forward conductor-engaging seal section 72A substantially until it has an inner diameter approaching that of intermediate seal section 76A, and good sealing engagement is obtained between the wire seal and the conductor at this location. Reduced diameter annular portion 94A along rear seal section 80A has been also substantially expanded by conductor 22A, providing good sealing engagement. The outer shape of rear seal section 80A is modified by the outward expansion of annular portion 94A and has a bulge at 98A and forward and rearward tapers 100A, 102A.

In FIG. 4B, wire seal 70B maintains a shape similar to its molded shape, by reason of smaller diameter conductor 22B not having expanded so substantially forward conductor-engaging seal section 72B and annular portion 94B. Some bulging occurs at 98B, 100B and 102B and good sealing engagement is obtained at both 72B and 94B. In both cases, strain relieving protection against lateral stress or bending on the conductor is provided by rear seal section 80A, 80B, which protects the sealing engagement of wire seal 70A, 70B with the housing.

In the preferred embodiment of the wire seal of the present invention, the dimension of the reduced inner diameter at forward seal section 72 and annular portion 94 should be smaller than the outer diameter of the smallest wire size of those adjacent wire sizes for which the wire seal is intended to be used. The dimension of the larger inner diameter at intermediate seal section 76 should be larger than the diameter of the largest wire size of the wire sizes for which the wire seal is intended to be used. The outer diameter of intermediate seal section 76 should be larger than the inside diameter of enlarged rear portions 26 of terminal-receiving cavities 20 of connector housing 12, so that an interference fit exists between wire seal 70 and the sidewalls of rear cavity portion 26 to create sealing engagment. As disclosed in U.S. Pat. No. 4,150,866 it is advantageous for forward conductor-engaging seal section 72 to be axially spaced from intermediate seal section 76 which engages the cavity sidewalls.

With the wire seal of the present invention, substantial contact of surfaces occurs between the wire seal and a terminated conductor being inserted thereinto or removed therefrom under radially inward compressive force, which would generate substantial frictional resistance increasing the likelihood of tearing of surface portions of the wire seal. It is preferred that, in lieu of a lubricating substance such as alcohol being applied to terminated conductor as is sometimes done, the wire seal have inherent lubricity to reduce the coefficient of friction. A moldable composition preferred to mold such wire seals having inherent lubricity, is disclosed in U.S. patent application Ser. No. 735,418 filed May 17, 1985. With such inherent lubricity, surface friction is reduced, and concomitantly the likelihood of tearing is also lowered.

Other variations may be made to the preferred embodiment within the spirit of the invention and the scope of the claims.

What is claimed is:

1. A wire sealing means for an electrical conductor secured in a terminal-receiving cavity of an electrical connector housing, comprising an elastomeric wire seal having:

a forward section of a preselected inner diameter and thickness and being elastically deformable radially outwardly;

a frustoconical section extending rearwardly from said forward section and having an increasing inner and outer diameter;

an intermediate cylindrical section of enlarged inner diameter and a preselected enlarged outer diameter rearwardly from said frustoconical section;

a rearward section extending rearwardly from said intermediate section and said terminal receiving cavity and being elastically deformable radially outwardly said rearward section comprising a cylindrical outer peripheral surface; and a profiled bore extending axially through said wire seal;

said rearward seal section having an annular portion extending radially inwardly into said profiled bore having a preselected inner diameter less than the portion of the profiled bore extending through said rearward section said annular portion and said cylindrical outer peripheral surface being radially expanded upon insertion of said electrical conductor.

2. A wire sealing means as set forth in claim 1 wherein said profiled bore rearwardly from said annular portion has a rearward and radially outward gradual taper.

3. A wire sealing means as set forth in claim 1 wherein said profiled bore forwardly from said annular portion has a forward and radially outward gradual taper.

4. A wire sealing means as set forth in claim 1 wherein said inner diameter of said forward section and said inner diameter of said annular portion are selected to be less than the diameter of a said electrical conductor to be inserted therethrough for sealing engagement therewith, said thickness of said forward section is selected to permit radially outward deformation by said conductor upon insertion therethrough, and said outer diameter of said intermediate section is selected to be larger than the diameter of a portion of said terminal-receiving cavity into which said wire seal is to be disposed.

5. A wire sealing means as set forth in claim 1 wherein said wire seal has inherent lubricity.

6. A wire sealing means as set forth in claim 1 wherein said wire seal has an annular stop section at a rearward end of said intermediate cylindrical section.

7. A wire sealing means as set forth in claim 6 wherein said annular portion is axially proximate said annular stop section.

8. An electrical connector assembly comprising:

a dielectric connector housing having at least one terminal-receiving cavity extending axially therethrough and having a rearward cavity portion;

an electrical conductor corresponding to each said terminal-receiving cavity and having an electrical terminal terminated onto an end thereof, each said terminated conductor being insertable and securable in a respective said terminal-receiving cavity from a rear surface of said housing; and an elastomeric wire seal associated with each said terminal-receiving cavity and said corresponding terminated conductor, each said wire seal being securable in a said rearward cavity portion, wherein each said wire seal comprises:

(a) a forward section having an inner diameter less than the diameter of said conductor and a thickness permitting radially outward elastic deformation by said conductor upon insertion therethrough;

(b) a frustoconical section extending rearwardly from said forward section and having an increasing inner and outer diameter;

(c) an intermediate cylindrical section rearwardly from said fructoconical section and having an outer diameter larger than the diameter of said rearward cavity portion whereby an interference fit is obtained between said intermediate cylindrical section of said wire seal and said rearward cavity portion;

(d) a rearward section extending rearwardly from said intermediate cylindrical section and disposed rearwardly of a rear surface of said housing when said wire seal is secured in said rearward cavity portion said rearward section comprising a cylindrical outer peripheral surface and (e) a profiled bore extending axially through said wire seal, said rearward section having an annular portion extending radially inwardly into said profiled bore having an inner diameter less than the diameter of said conductor, and said rearward section being deformable radially outwardly at said annular portion and said cylindrical outer peripheral surface by said conductor upon insertion therethrough and sealingly engaging said conductor thereat.

9. An electrical connector assembly as set forth in claim 8 wherein said profiled bore of said wire seal rearwardly from said annular portion has a rearward and radially outward gradual taper.

10. An electrical connector assembly as set forth in claim 8 wherein said profiled bore of said wire seal forwardly from said annular portion has a forward and radially outward gradual taper.

11. An electrical connector assembly as set forth in claim 8 wherein said wire seal has inherent lubricity.

12. An electrical connector assembly as set forth in claim 8 wherein said wire seal has an annular stop section at a rearward end of said intermediate cylindrical section which engages a cooperating stop means of said rearward cavity section of said housing to prevent axially forward movement of said wire seal upon securing thereof in said rearward cavity section.

13. An electrical connector assembly as set forth in claim 12 wherein said annular portion of said wire seal is axially proximate said annular stop section.

* * * * *